United States Patent [19]

Lundahl

[11] 4,047,825

[45] Sept. 13, 1977

[54] ROLLABLE WALK GUIDE

[75] Inventor: Robert O. Lundahl, Brethren, Mich.

[73] Assignee: The Raymond Lee Organization, Inc., New York, N.Y.

[21] Appl. No.: 695,593

[22] Filed: June 14, 1976

[51] Int. Cl.[2] ..... E01C 5/08; E01C 11/16

[52] U.S. Cl. ..... 404/70; 404/37; 52/384

[58] Field of Search ..... 404/35, 45, 40, 70, 404/34, 37; 52/388, 676, 688, 749, 384

[56] References Cited

U.S. PATENT DOCUMENTS

| | | | |
|---|---|---|---|
| 636,200 | 10/1899 | Frink | 404/37 X |
| 658,868 | 10/1900 | Rosenbaum | 404/37 X |
| 759,760 | 5/1904 | Shram | 52/676 |
| 1,369,949 | 3/1921 | White | 52/688 |
| 1,836,964 | 12/1931 | Grigsby | 404/37 X |
| 1,952,721 | 3/1934 | MacChesney | 404/70 |
| 2,184,469 | 12/1939 | Poston | 404/45 X |
| 2,836,108 | 5/1958 | Monick | 404/40 |
| 3,148,482 | 9/1964 | Neale | 404/37 X |
| 3,274,727 | 9/1966 | Zander | 52/384 X |
| 3,375,633 | 4/1968 | Pourtau | 52/749 |

*Primary Examiner*—Nile C. Byers, Jr.
*Attorney, Agent, or Firm*—Howard I. Podell

[57] ABSTRACT

A wire grid shaped with brick size spaces which may be transported or stored as a roll, and which is adaptable for serving as a permanent guide and reinforcement when unrolled onto a flat path with bricks subsequently individually mounted in each of the grid spaces.

2 Claims, 3 Drawing Figures

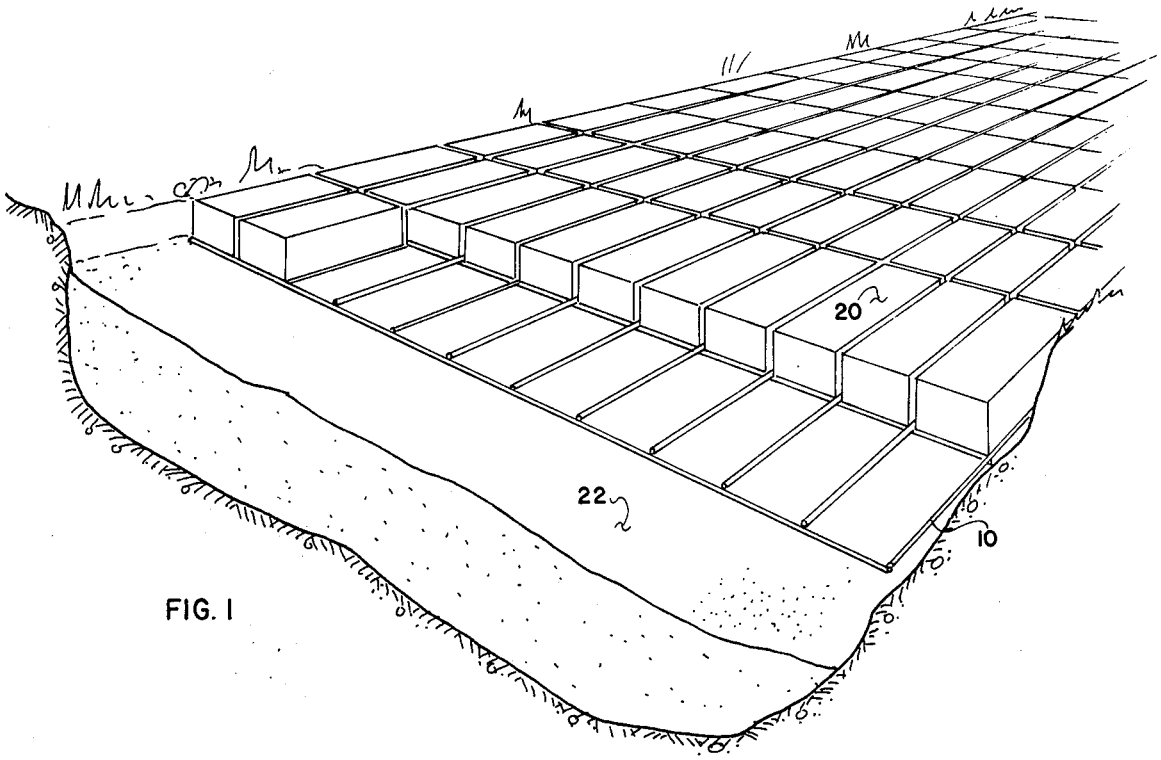
FIG. 1
FIG. 2
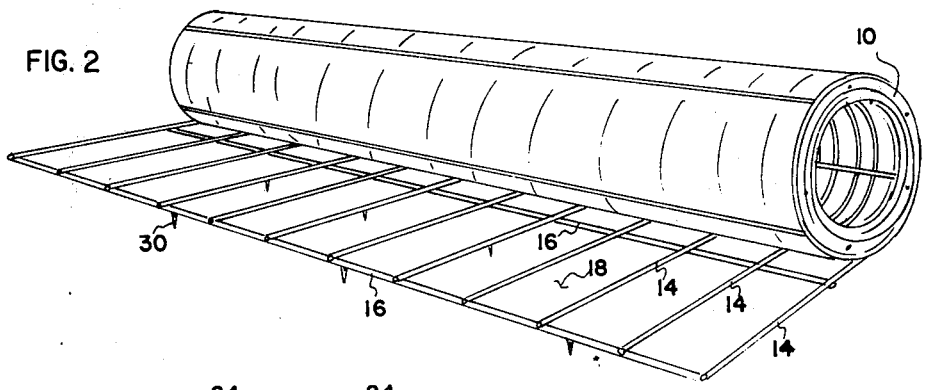
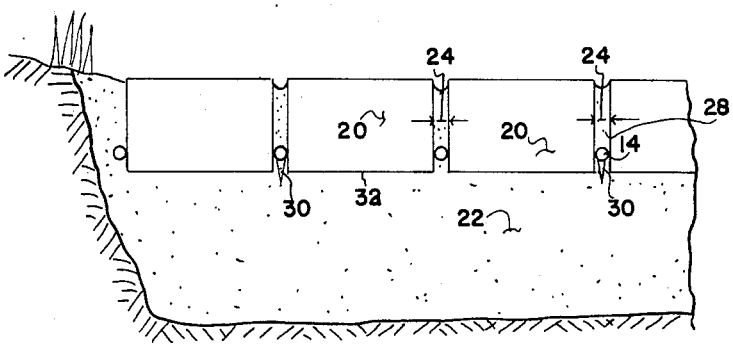
FIG. 3

ROLLABLE WALK GUIDE

SUMMARY OF THE INVENTION

My invention is a wire grid shaped with brick size spaces which may be transported or stored as a roll, and which is adaptable for serving as a permanent guide and reinforcement when unrolled onto a flat path with bricks subsequently individually mounted in each of the grid spaces.

By means of my invention, a brick path may be readily set in place with sand or mortar maintaining the bricks and the grid in fixed location.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention in use;

FIG. 2 is a perspective view of the invention preparatory to use; and

FIG. 3 is a sectional view of the invention in use.

DESCRIPTION OF THE PREFERRED EMBODIMENT

Turning now descriptively to the drawings, in which similar reference characters denote similar elements through the several views, FIGS. 1–3 illustrate the invention in the form of a continuous length of wire grid 10 which may be rolled, for storage and transport prior to use, as shown in FIG. 2.

Grid 10 is formed of spaced semi-flexible wire members with a plurality of parallel uniformly spaced longitudinal members 14 fixed at uniform intervals to a plurality of parallel spaced lateral members 16 to bound a plurality of rectangular openings 18, each of the general size of the outline of a standard brick 20, so that when grid 10 is laid out flat on the prepared bed 22 of a path, each opening 18 may be individually filled by a brick 20, with all bricks 20 uniformly separated by spaces 24 the thickness of members 14 and 16 in a uniform array.

Mortar or sand 28 may be employed to fill the spaces 24 to permanently retain the bricks 20 and grid 10 in place.

Members 14 and 16 may be fixed at irregular intervals to spikes 30 that each extend from the underside of the grid 10 to serve as anchors and to space grid 10 above the surface of the prepared bed 22 of the path so that the grid will rest above the bottom plane 32 of the installed bricks 20.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A rectangular open continuous grid of wire elements which is initially formed as a roll, with the grid shaped of uniformly spaced parallel longitudinal members joined to uniformly spaced parallel lateral members that bound uniform rectangular openings, each opening of the general size of the outline of a brick, together with pointed projections perpendicularly mounted at intervals to the members, and projecting from one side of the grid, said projections serving as means to anchor the grid to a flat base upon which it is laid.

2. The combination as recited in claim 1 in which the grid is laid as a flat path upon a flat base and fitted with bricks individually located in the grid openings to form a finished brick walk, with each brick resting on the base on which the grid is laid.

* * * * *